United States Patent [19]

Roseby

[11] 3,969,963

[45] July 20, 1976

[54] ADJUSTABLE PIPE WRENCH

[76] Inventor: Bernard Roseby, 150 W. Edith Ave., No. 21, Los Altos, Calif. 94022

[22] Filed: Sept. 25, 1974

[21] Appl. No.: 509,015

[52] U.S. Cl. ..... 81/66 A; 81/91 B

[51] Int. Cl.[2] ..... B25B 13/50; B25B 13/28

[58] Field of Search ..... 81/66 A, 91 R, 91 B

[56] References Cited.

UNITED STATES PATENTS

| | | | |
|---|---|---|---|
| 857,220 | 6/1907 | Zanto | 81/91 R |
| 1,471,415 | 10/1923 | Platt | 81/91 R X |
| 1,611,808 | 12/1926 | Bessolo | 81/91 R X |
| 1,906,696 | 5/1933 | Lynch | 81/66 A |
| 2,557,202 | 6/1951 | Raymond et al. | 81/91 B X |
| 3,097,552 | 7/1963 | Kelley | 81/66 A |
| 3,662,867 | 5/1972 | Kinzbach | 81/91 B X |

*Primary Examiner*—Al Lawrence Smith
*Assistant Examiner*—James G. Smith

[57] ABSTRACT

A wrench with relatively movable members to transmit gripping force between said members comprising a swinging element with the rear face of arcuate form on which side are gear teeth, a series of connecting links the final link forming the handle, said handle having an arcuate form on the outer face of similar profile to the first swinging element on which handle arcuate face are formed gear teeth in such a manner that, when the links enclose a pipe or similar round object and force is applied to said handle, the meshing gear teeth on the opposing arcuate faces drive the swinging element into frictional engagement with the pipe, urging said pipe into frictional engagement with the inside faces of the other links, said links having teeth formed on the inside faces in such a manner as to grip said pipe and angled in such a manner that, when further force is applied to said handle, the entire assembly is rotated about the longitudinal center line of the said pipe.

1 Claim, 4 Drawing Figures

ADJUSTABLE PIPE WRENCH

BACKGROUND OF THIS INVENTION

The present invention relates to a wrench for holding or turning pipes or other circular objects, that is instantly adjustable and capable of exerting high gripping and turning forces.

Presently available and patented pipe wrenches are adjusted either by screw adjusting jaws, or by a cam action, or by changing interchangeable pads or jaws.

The adjustable by screw types are limited in the range of pipe size that they can accomodate by the length of the jaws, are heavy and complex in construction. Their gripping action is limited and obtained by spreading the jaws round the half of a pipe against a spring, and are liable to slippage, particularly when operated in a difficult position or confined area.

The types with interchangeable jaws to accomodate varying pipe sizes are complex and expensive and require mechanical work to adjust.

Since, in the case of this invention, the grip applying members are driven towards each other around the pipe, by the mechanical action of interfacing gear forms, an automatic and powerful gripping action is provided that accepts a wide range of pipe sizes that is a greater size range than existing devices. The wrench can easily be "wrapped" around a pipe in close proximity to other obstructions and can be laid almost into a straight line for transporting or stowing.

SUMMARY OF THE INVENTION

The invention relates to an adjustable, self locking pipe wrench. This invention is an improvement to my previous invention of an adjustable, self locking pipe wrench for which an application for a patent was filed under number 445,744, now abandoned.

The wrench is formed from a series of hinged links, so arranged that a pipe, or other round object, enclosed within the links is gripped by serrations, or teeth, formed on the inner faces of two or more of the links and, as a force is applied to the handle, a force is applied to the anvil by means of meshing gear form teeth on the handle mating with identical teeth on the anvil and thus driving the anvil into contact with the pipe which is, in turn, forced against the inner teeth on the other links on the far side of the pipe. Further application of force to the handle rotates the entire assembly thus turning the pipe.

The invention is further described in connection with the accompanying drawing in which.

Figure 1:
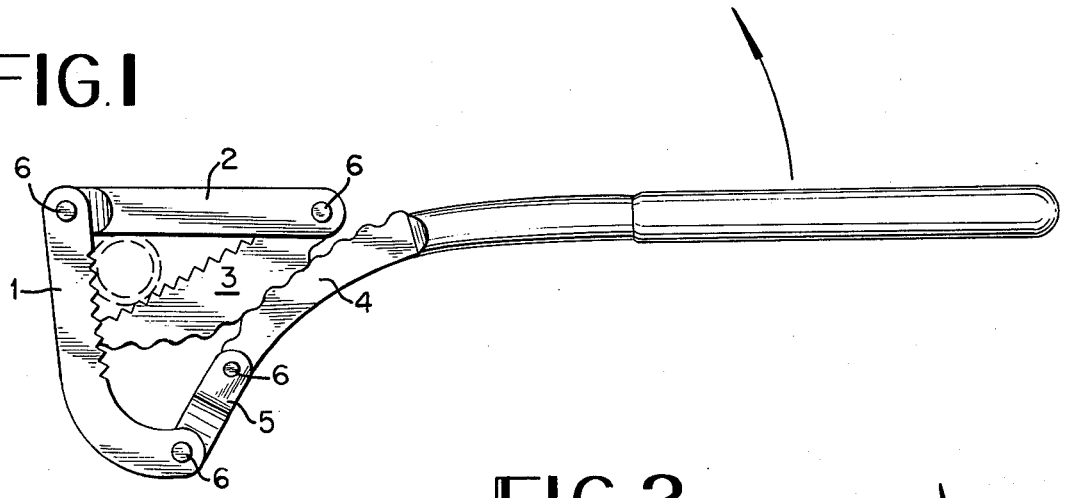
FIG. 1 is a plan view of the wrench engaging a small diameter pipe.

The main link (1) is slotted at each end to accept, at one end the connecting link (2) and, at the other end, the handle link (5). The opposite end of the connecting link (2) is slotted to accept the anvil link (3). All the links are connected by means of swivel pins (6) which permit rotary motion between any pair of pieces or all pieces, in one plane only.

The inner face of the handle (4) which is connected by a pin (6) to the handle link (5), has formed upon it teeth of gear form of identical shape and pitch to teeth also formed on the outer face of the anvil link (3).

Figure 2:
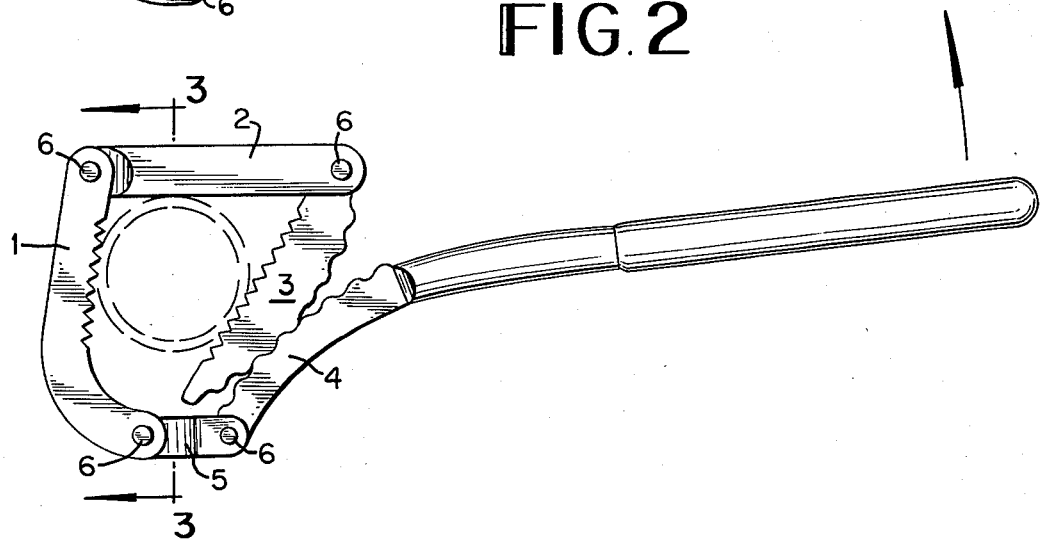
FIG. 2 is a plan view of the wrench engaging a larger diameter pipe.
Figure 3:
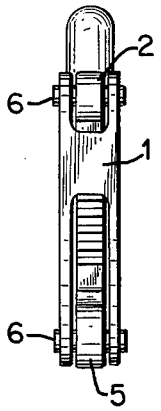
FIG. 3 is an end view of the wrench.
Figure 4:
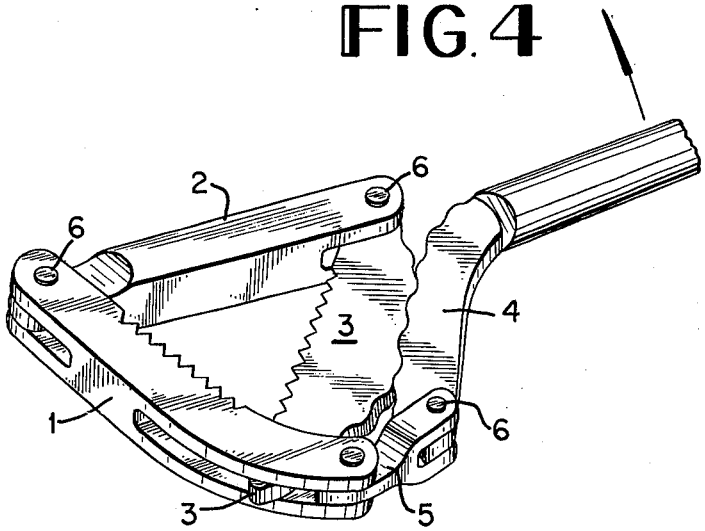
FIG. 4 is a view of the wrench showing the anvil entering a slotted connecting link to permit a small diameter pipe to be gripped.

As a force is applied to the handle (4) in the direction indicated in the drawings FIGS. 1, 2 & 4, the anvil link (3) is driven against the pipe in such a way that the teeth on the inner faces of the anvil (3) grip the pipe. At the same time, responding to the same force, the pipe is forced by the anvil link (3) against the teeth formed on the inside face of the main link (1).

The teeth on handle (4) and anvil link (3), being meshed together as gears, prevent any loosening motion between these pieces and, in fact, tend to drive the anvil into firmer contact with the pipe, so that the pipe is firmly held by the wrench.

As force is continued to be applied to the handle, and since the pipe is gripped and prevents further rotary motion of the anvil (3) the entire assembly is rotated.

To accomodate smaller pipe sizes, handle (4) may be so slotted as to permit anvil (3) to pass through the slot as shown in FIG. 4. Because the turning force applied also causes the gear forms on the anvil (3) and handle (4) to attempt to move relative to one another, the greater the turning force applied to the assembly, the greater the gripping force on the pipe.

Removable, replaceable hardened teeth may be fitted in lieu of fixed teeth.

I claim:

1. An adjustable wrench comprising an arcuate, elongated handle having a convex face with gear teeth thereon and a smooth concave face opposite the convex face, a swivel link pivotally connected to one end of the handle, a main link having one end curved and pivotally connected to said swivel link, the other end of said main link is pivotally connected to a connecting link, said connecting link is pivotally connected, at the end opposite the end connected to the main link, to an anvil, said anvil having a work engaging straight surface with teeth, said teeth being inclined to grip the work in one direction and slip around the work in the other, and mating gear teeth on a curved surface of said anvil to mesh with said gear teeth on said elongated handle, said main link having oppositely inclined teeth on a work engaging surface thereof, said curved surface of said anvil being opposite the work engaging straight surface whereby force applied to said handle causes said gear teeth to mesh with said mating gear teeth and force said anvil to engage a workpiece, said main link having a bifurcated portion at said curved end to receive the end of said anvil opposite its pivotal connection to said connecting link thus allowing the said wrench to be used on a variety of different sizes of workpieces.

* * * * *